US007358954B2

(12) United States Patent
Negley et al.

(10) Patent No.: US 7,358,954 B2
(45) Date of Patent: Apr. 15, 2008

(54) SYNCHRONIZED LIGHT EMITTING DIODE BACKLIGHTING SYSTEMS AND METHODS FOR DISPLAYS

(75) Inventors: Gerald H. Negley, Hillsborough, NC (US); Antony P. van de Ven, Sai Kung (HK)

(73) Assignee: Cree, Inc., Durham, NC (US)

( * ) Notice: Subject to any disclaimer, the term of this patent is extended or adjusted under 35 U.S.C. 154(b) by 436 days.

(21) Appl. No.: 11/098,085

(22) Filed: Apr. 4, 2005

(65) Prior Publication Data

US 2006/0221044 A1 Oct. 5, 2006

(51) Int. Cl.
*G09G 3/36* (2006.01)

(52) U.S. Cl. ..... 345/102; 345/87

(58) Field of Classification Search ..... 345/102; 315/61, 69

See application file for complete search history.

(56) References Cited

U.S. PATENT DOCUMENTS

| | | | | |
|---|---|---|---|---|
| 4,772,885 | A | 9/1988 | Uehara et al. | |
| 5,166,815 | A | 11/1992 | Elderfield | |
| 6,980,176 | B2 | 12/2005 | Matsumoto et al. | |
| 7,116,308 | B1 * | 10/2006 | Heeks et al. | 345/102 |
| 2002/0006044 | A1 | 1/2002 | Harbers et al. | |
| 2002/0149576 | A1 * | 10/2002 | Tanaka et al. | 345/204 |
| 2004/0218388 | A1 | 11/2004 | Suzuki | |
| 2004/0239839 | A1 | 12/2004 | Hong | |
| 2004/0264212 | A1 * | 12/2004 | Chung et al. | 362/561 |
| 2005/0007306 | A1 * | 1/2005 | Ilsaka et al. | 345/32 |
| 2005/0190141 | A1 | 9/2005 | Roth et al. | |
| 2005/0231976 | A1 | 10/2005 | Keuper et al. | |
| 2006/0152172 | A9 | 7/2006 | Mueller et al. | |
| 2007/0001994 | A1 | 1/2007 | Roth | |

FOREIGN PATENT DOCUMENTS

| | | | |
|---|---|---|---|
| EP | 1 380 876 | A1 | 1/2004 |
| JP | 4-159519 | A | 6/1992 |
| JP | 9-146089 | A | 6/1997 |
| WO | WO 99/66483 | A1 | 12/1999 |
| WO | WO 01/43113 | A1 | 6/2001 |
| WO | WO 03/056876 | A2 | 7/2003 |
| WO | WO 03/056876 | A3 | 7/2003 |
| WO | WO 03/091771 | A1 | 11/2003 |

OTHER PUBLICATIONS

Negley, "*Reflective Optical Elements for Semiconductor Light Emitting Devices*", U.S. Appl. No. 10/898,608, filed Jul. 23, 2004.

(Continued)

*Primary Examiner*—Alexander Eisen
*Assistant Examiner*—Kenneth B Lee
(74) *Attorney, Agent, or Firm*—Myers Bigel Sibley & Sajovec, P.A.

(57) ABSTRACT

A display screen includes at least two arrays of at least two different color picture elements. A backlighting system for the display includes at least two arrays of Light Emitting Diode (LED) devices that are configured to radiate light of at least two colors in a light path that impinges on the display screen, to provide backlighting on the display screen. A synchronizer is configured to synchronously activate and deactivate at least a first one of the arrays of LED devices and at least a first one of the arrays of color picture elements. Different arrays of synchronously activated and deactivated LED devices and color picture elements also may be alternatingly synchronously activated and deactivated. The backlighting also may be pulsed.

12 Claims, 11 Drawing Sheets

OTHER PUBLICATIONS

Negley et al., "*Light Emitting Diode Arrays for Direct Backlighting by Liquid Crystal Displays*", U.S. Appl. No. 11/022,332, filed Dec. 23, 2004.

Negley et al., "*Light Emitting Diode Backlighting Systems and Methods That Use More Colors Than Display Picture Elements*", U.S. Appl. No. 11/098,126, filed Apr. 4, 2005.

International Search Report, PCT International Application No. PCT/US2006/001220; Jan. 26, 2007.

Invitation to Pay Additional Fees and Partial Search Report, PCT International Application No. PCT/US2006/001220; Jun. 6, 2006.

Notification of Transmittal of the International Search Report and the Written Opinion of the Intenational Searching Authority, or the Declaration, International Search Report, and Written Opinion of the International Searching Authority, PCT International Application No. PCT/US2006/002117, May 30, 2006.

Notification of Transmittal of the International Search Report and the Written Opinion of the International Searching Authority, or the Declaration, International Search Report, and Written Opinion of the International Searching Authority, PCT International Application No. PCT/US2005/044805, May 9, 2006.

* cited by examiner

| LEDs | x | y | nm |
|---|---|---|---|
| R | 0.6944 | 0.3053 | 622 |
| Y | 0.5888 | 0.4105 | 593 |
| G | 0.1868 | 0.6969 | 529 |
| C | 0.0795 | 0.5013 | 501 |
| B | 0.1285 | 0.0742 | 472 |
| rB | 0.1479 | 0.0321 | 460 |

| | non alternating | | | | alternating | | | | | | |
|---|---|---|---|---|---|---|---|---|---|---|---|
| | (R+G+rB) | | (R+G+B) | | (R+rB)&(G) | | (R+B)&(G) | | | (R+G+rB)&(C+Y) | |
| | x | y | x | y | x | y | x | y | | x | y |
| R | 0.6956 | 0.3035 | 0.6957 | 0.3036 | 0.6973 | 0.3018 | 0.6973 | 0.3018 | R | 0.6956 | 0.3035 |
| G | 0.1863 | 0.6927 | 0.1704 | 0.6373 | 0.1738 | 0.7288 | 0.1738 | 0.7288 | Y | 0.6162 | 0.3832 |
| B / rB | 0.1417 | 0.0726 | 0.1248 | 0.1057 | 0.1476 | 0.0302 | 0.1297 | 0.0624 | G | 0.1863 | 0.6927 |
| | | | | | | | | | C | 0.0616 | 0.3561 |
| | | | | | | | | | rB | 0.1417 | 0.0726 |
| % ntsc | 105% | | 93% | | 119% | | 116% | | | | |

SYNCHRONIZED LIGHT EMITTING DIODE BACKLIGHTING SYSTEMS AND METHODS FOR DISPLAYS

FIELD OF THE INVENTION

This invention relates to displays such as Liquid Crystal Displays (LCDs), and more particularly, to backlighting of displays, such as LCDs.

BACKGROUND OF THE INVENTION

Display screens are widely used for computer monitors, televisions and many other display applications. Some flat panel display screens include an array of optical shutters and a backlight system that impinges light on the display screen.

For example, LCD devices are widely used in flat panel displays for monitors, televisions and/or other display applications. As is well known to those having skill in the art, an LCD display generally includes an array of LCD devices that act as an array of optical shutters. Transmissive LCD displays employ backlighting using, for example, fluorescent cold cathode tubes above, beside and sometimes behind the array of LCD devices. A diffusion panel behind the LCD devices can be used to redirect and scatter the light evenly to provide a more uniform display.

Conventional shuttered display devices generally include three different color picture elements (often referred to as pixels and/or subpixels), generally red (R), green (G) and blue (B) picture elements. A backlight system for shuttered display devices may be configured to uniformly radiate light on the display screen that provides the appearance of white light.

As is well known to those having skill in the art, the combination of red, green and blue picture elements define a gamut of colors or color gamut, which is that portion of the visible color space that can be represented by the display. The visible color space and a color gamut therein are generally represented in an x-y chromaticity diagram. In order to improve the accuracy of images that can be displayed on the display, it may be generally desirable to increase the color gamut of a display.

SUMMARY OF THE INVENTION

Backlight systems for display screens that include at least two arrays of a respective at least two different color picture elements may be provided, according to various embodiments of the present invention, by providing at least two arrays of LED devices that are configured to radiate light of a respective at least two colors in a light path that impinges on the display screen, to provide backlighting on the display screen. A synchronizer is configured to synchronously activate and deactivate at least a first one of the arrays of LED devices and at least a first one of the arrays of color picture elements.

In some embodiments, the synchronizer is configured to synchronously activate and deactivate at least a first one of the arrays of LED devices and at least a first one of the arrays of color picture elements, and to alternatingly synchronously activate and deactivate at least a second one of the arrays of LED devices and at least a second one of the arrays of color picture elements. Moreover, in some embodiments, the synchronizer is configured to activate and deactivate the at least a first one of the arrays of LED devices multiple times in synchronism with a single activation and deactivation of the at least a first one of the arrays of color picture elements.

In other embodiments, the synchronizer is configured to pulse the at least the first one of the arrays of LED devices multiple times in synchronism with a single activation and deactivation of at least a first one of the arrays of color picture elements.

In some embodiments of the present invention, the display screen that includes at least two arrays of the respective at least two different color picture elements comprises an array of LCD devices including at least three color filters thereon. In some embodiments, the array of LCD devices includes red, green and blue color filters thereon, to provide red, green and blue color picture elements, the at least two arrays of LED devices include arrays of red, green and blue LED devices, and the synchronizer is configured to synchronously activate the array of green picture elements and the array of green LED devices. In other embodiments, the synchronizer is configured to synchronously activate the array of blue picture elements and the array of blue LED devices. In still other embodiments, the synchronizer is configured to synchronously activate and deactivate the array of blue LED devices and the array of blue color picture elements and to alternatingly synchronously activate and deactivate the array of green LED devices and the array of green color picture elements. The red LED devices may be activated with the green and blue LED devices, or may be synchronously activated one or the other.

In still other embodiments, the at least two arrays of LED devices include arrays of red, green, blue and cyanine (also referred to as cyan) LED devices, and the synchronizer is configured to synchronously activate and deactivate the arrays of green and blue LED devices and the arrays of green and blue color picture elements, and to alternatingly synchronously activate and deactivate the array of cyanine LED devices and the arrays of red, green and blue color picture elements. The red LED devices may be synchronized with the green and blue LED devices or with the cyanine LED devices, or with both sets.

In yet other embodiments, the at least two arrays of LED devices include arrays of red, green, blue, cyanine and amber (also referred to as yellow) LED devices, and the synchronizer is configured to synchronously activate and deactivate the arrays of green and blue LED devices and the array of green and blue color picture elements, to alternatingly synchronously activate and deactivate the arrays of cyanine and amber LED devices and the arrays of red, green and blue color picture elements. In still other embodiments, the synchronizer is configured to synchronously activate and deactivate the array of green LED devices and the array of green picture elements, to alternatingly synchronously activate and deactivate the array of blue LED devices and the array of blue color picture elements, and to alternatingly synchronously activate and deactivate the array of cyanine (and, in some embodiments, amber) LED devices and the arrays of red, green and blue color picture elements. The red LED devices may be activated and deactivated with one or more of the LED devices or may remain on all the time.

It will be understood by those having skill in the art that embodiments of the present invention have been described above in terms of backlight systems for display screens and display screens including backlight systems. However, other embodiments of the present invention provide analogous methods of increasing the color gamut of a display panel that includes an array of LCD devices and at least two color filters thereon, and at least two arrays of LED devices that are configured to radiate light of a respective at least two colors in a light path that impinges on the display screen, to provide backlighting on the display screen. These methods may include synchronously activating and deactivating at least a first one of the arrays of LED devices and at least a first one of the arrays of color picture elements. Various embodiments as described above may be provided according to these method aspects. Moreover, embodiments of the invention may be used with arrays of backlighting light sources other than LEDs, such as field emitters/phosphor arrays.

Other embodiments of the present invention can provide backlight systems for display screens that include an array of at least two different color picture elements. These backlight systems include an array of pulsating LED devices that are configured to radiate pulses of light in a light path that impinges on the display screen, to provide backlighting on the display screen. These embodiments can reduce image degradation such as blur and/or flicker on a display panel by pulsing the array of LED devices to radiate pulses of light in the light path that impinges on the display screen, to provide pulsed backlighting on the display screen.

DETAILED DESCRIPTION

Figure 1:
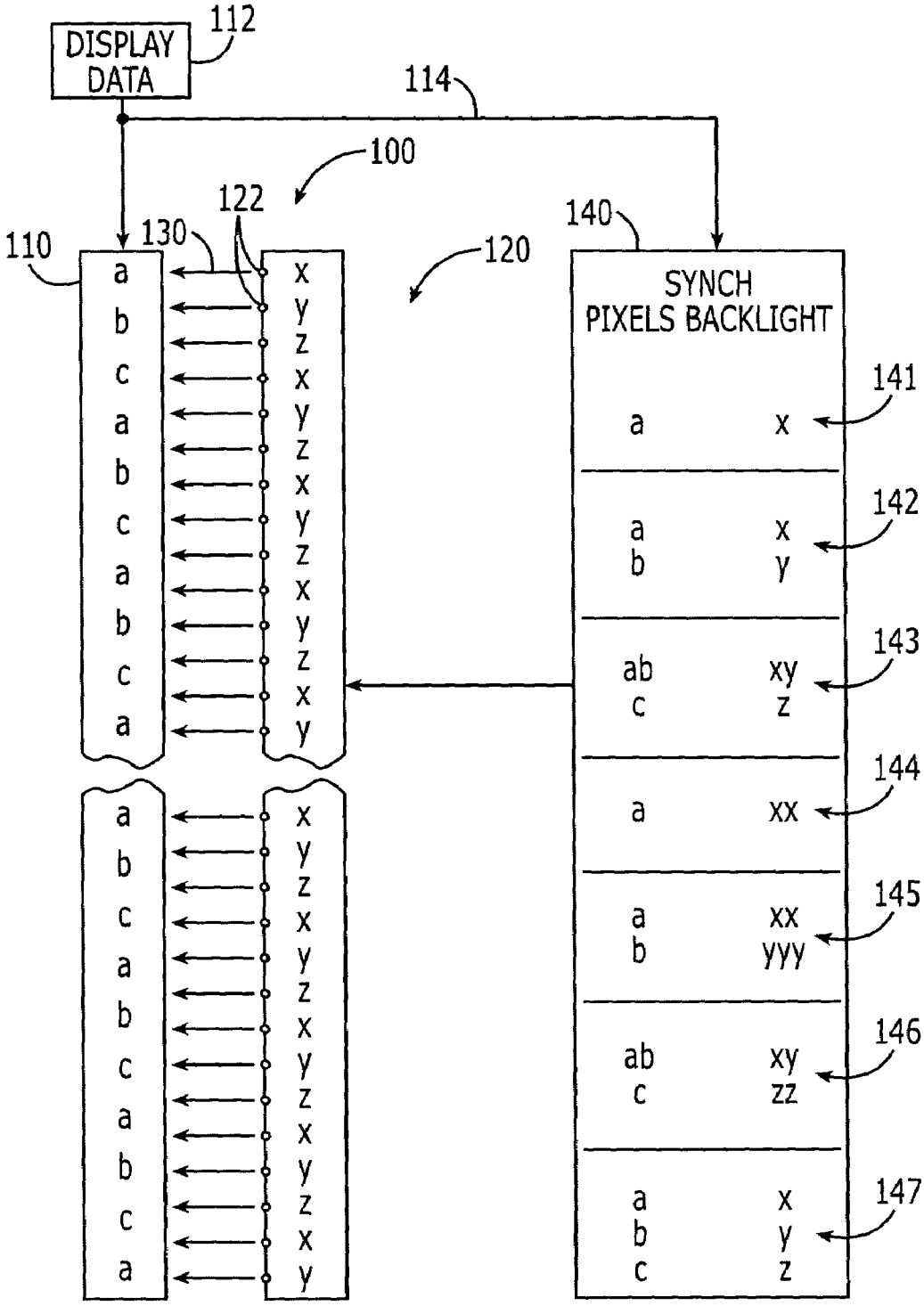
FIGS. 1 and 2 are cross-sectional views of display panels according to various embodiments of the present invention.

The present invention now will be described more fully hereinafter with reference to the accompanying drawings, in which embodiments of the invention are shown. However, this invention should not be construed as limited to the embodiments set forth herein. Rather, these embodiments are provided so that this disclosure will be thorough and complete, and will fully convey the scope of the invention to those skilled in the art. In the drawings, the thickness of layers and regions are exaggerated for clarity. Like numbers refer to like elements throughout. As used herein the term "and/or" includes any and all combinations of one or more of the associated listed items and may be abbreviated as "/".

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, regions, steps, operations, elements, and/or components, but do not preclude the presence or addition of one or more other features, regions, steps, operations, elements, components, and/or groups thereof.

It will be understood that when an element, such as a layer or region, is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

It will be understood that, although the terms first, second, etc. may be used herein to describe various elements, components, regions, layers and/or sections, these elements, materials, regions, layers and/or sections should not be limited by these terms. These terms are only used to distinguish one element, material, region, layer or section from another element, material, region, layer or section. Thus, a first element, material, region, layer or section discussed below could be termed a second element, material, region, layer or section without departing from the teachings of the present invention.

Furthermore, relative terms, such as "lower", "base", or "horizontal", and "upper", "top", or "vertical" may be used herein to describe one element's relationship to another element as illustrated in the Figures. It will be understood that relative terms are intended to encompass different orientations of the device in addition to the orientation depicted in the Figures. For example, if the device in the Figures is turned over, elements described as being on the "lower" side of other elements would then be oriented on "upper" sides of the other elements. The exemplary term "lower", can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below. Moreover, the terms "front" and "back" are used herein to describe opposing outward faces of a flat panel display. Conventionally, the viewing face is deemed the front, but the viewing face may also be deemed the back, depending on orientation.

Embodiments of the present invention are described herein with reference to cross section illustrations that are schematic illustrations of idealized embodiments of the present invention. As such, variations from the shapes of the illustrations as a result, for example, of manufacturing techniques and/or tolerances, are to be expected. Thus, embodiments of the present invention should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated, typically, may be rounded. Thus, the regions illustrated in the figures are schematic in nature and their shapes are not intended to illustrate the precise shape of a region and are not intended to limit the scope of the present invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

FIG. 1 is a cross-sectional view of display panels for flat panel displays that include backlight systems and methods according to various embodiments of the present invention. As shown in FIG. 1, these display panels 100 include a display screen 110 that includes at least two arrays of a respective at least two different color picture elements, such as three arrays labeled a, b and c in the display screen 110. A display data system 112 provides data to the display screen 110 at a predetermined refresh rate or refresh frequency. The design of a display screen 110 and a display data system 112 as described in this paragraph is well known to those having skill in the art and need not be described further herein.

Still referring to FIG. 1, a backlight system and method 120 for the display screen 110 includes at least two arrays of LED devices 122, such as three arrays labeled x, y and z in FIG. 1. The at least two arrays of LED devices 122 are configured to radiate light of a respective at least two colors in a light path 130 that impinges on the display screen 110 to provide backlighting on the display screen 110. It will be understood by those having skill in the art that the light path 130 is illustrated by parallel arrows for the sake of clarity, but that, conventionally, light from the various color LEDs mix in the mixing area between the LEDs and the display screen 110, to provide relatively uniform backlighting. The arrays of LED devices may be positioned to provide direct backlighting of the display screen as described, for example, in application Ser. No. 11/022,332, filed Dec. 23, 2004, entitled *Light Emitting Diode Arrays For Direct Backlighting Of Liquid Crystal Displays*, to coinventor Negley et al., to provide edge backlighting of the display screen, as described in application Ser. No. 10/898,608, filed Jul. 23, 2004, entitled *Reflective Optical Elements for Semiconductor Light Emitting Devices*, to coinventor Negley, and/or in other backlighting arrangements. It will be understood that the arrays of LED devices x, y, z may have a smaller pitch than, a larger pitch than, or the same pitch as, the arrays of picture elements a, b and c.

Still referring to FIG. 1, the backlight system and method 120 also includes a synchronizer (SYNCH) 140 that is configured to synchronously activate and deactivate at least a first one of the arrays of LED devices x, y and/or z, and at least a first one of the arrays of color picture elements (pixels) a, b and/or c. As shown in FIG. 1, in some embodiments, the synchronizer synchronously activates and deactivates LED devices and color picture elements by synchronizing the LED devices 122 to a signal 114 that is obtained from the display data 112. However, other techniques of synchronizing may be used by synchronizer 140, for example by generating a synchronization signal that is applied to both the display screen 110 and the array of LED devices 122. The overall design of a synchronizer is well known to those having skill in the art and need not be described in detail herein.

Various embodiments of synchronizing may be provided according to exemplary embodiments of the present invention. For example, as shown in Block 140 of FIG. 1, in embodiment 141, picture elements a and LEDs x are synchronously activated and deactivated independent of the other picture elements and LEDs. In a second embodiment 142, the synchronizer 140 is configured to synchronously activate and deactivate color picture elements a and LED devices x, and to alternatingly synchronously activate and deactivate picture elements b and LED devices y. In a third embodiment 143, picture elements a and b are synchronously activated and deactivated along with LEDs x and y and, alternatingly, picture elements c are synchronously activated and deactivated along with LEDs z.

In a fourth embodiment 144, the synchronizer 140 is configured to activate and deactivate at least a first one of the arrays of LED devices (such as x) multiple times in synchronism with a single activation and deactivation of at least a first one of the arrays of color picture elements (such as a). The synchronizer may be configured to pulse the at least a first one of the arrays of LED devices multiple times, in synchronism with a single activation and deactivation of the at least a first one of the arrays of color picture elements. Thus, in embodiment 144, the array of LEDs x is pulsed twice in synchronism with activation and deactivation of picture elements a. It will be understood that more than two pulses also may be provided. In embodiment 145, the LEDs x are pulsed twice in synchronism with the pixels a and, alternatingly, the LEDs y are pulsed three times in synchronism with activation of the pixels b. Embodiment 146 illustrates that pulsed and non-pulsed modes may be combined, for example by synchronously activating and deactivating picture elements a and b and LEDs x and y and, alternatingly, pulsing LEDs z while activating and deactivating picture elements c. Finally, embodiment 147 illustrates that the alternating synchronous activation may take place in groups of three or more and not only in groups of two. It also will be understood that modes 141-147 are merely illustrative, and that other modes and combinations and subcombinations of modes 141-147 may be provided according to various embodiments of the present invention.

Figure 2:
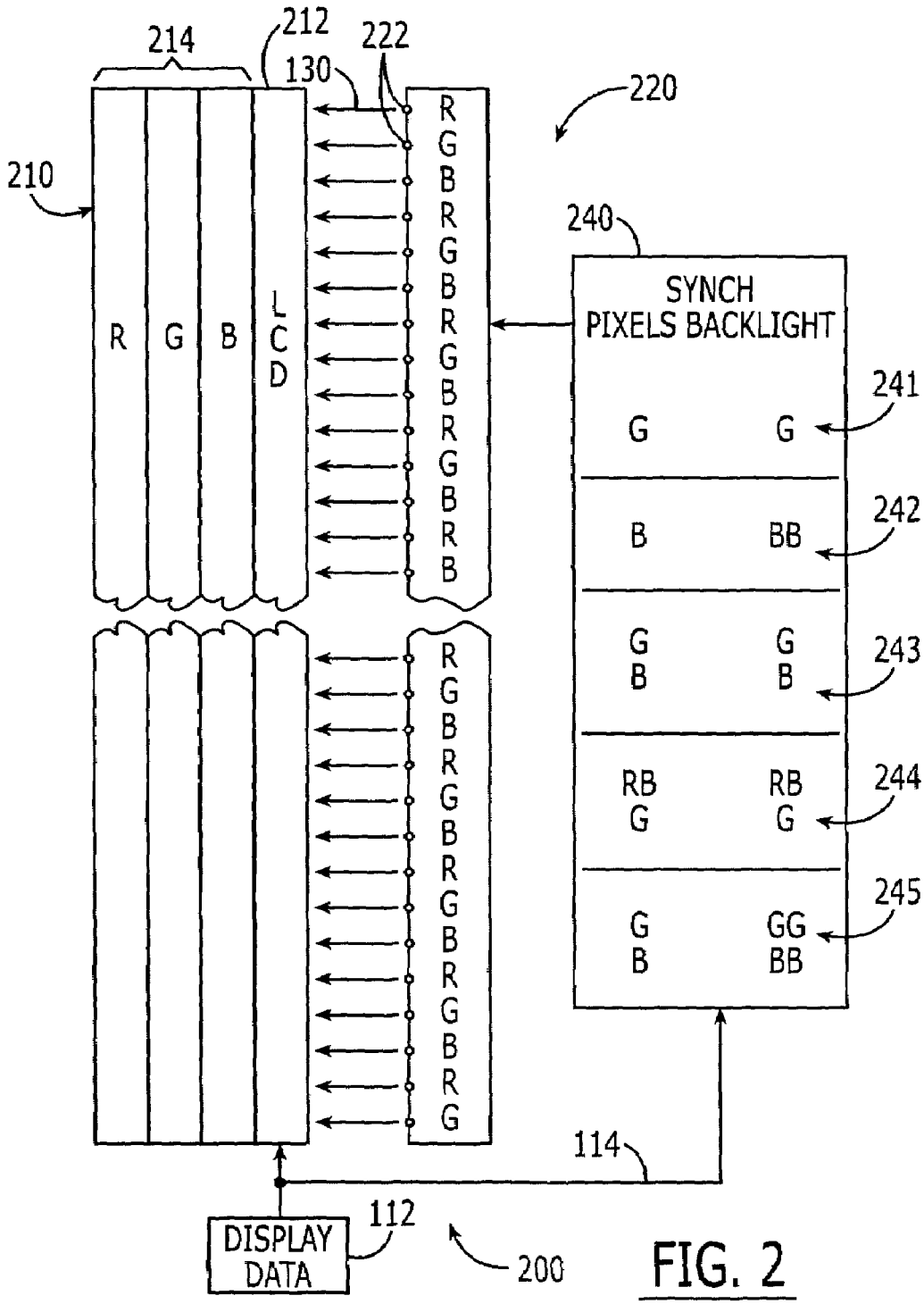

FIG. 2 is a block diagram of display panels according to other embodiments of the present invention. In these embodiments, the display screen 210 includes a two-dimensional array of LCD devices 212, and at least two color filters 214 thereon. In FIG. 2, three color filters 214R, 214G and 214B, corresponding to red, green and blue color filters, are shown. As is well known to those having skill in the art, the array of LCD devices 212 and the three color filters 214 define three arrays of three different color picture elements (pixels). Moreover, the backlight system and method 220 includes arrays of red, green and blue LED devices 222R, 222G and 222B, respectively. In some embodiments, the red LEDs have a center frequency of about 625 nm, the green LEDs have a center frequency of about 535 nm, and the blue LEDs have a center frequency of about 460 nm.

In some embodiments, the synchronizer 240 may be configured to synchronously activate one or more of the arrays of red, green or blue picture elements and one or more of the arrays of red, green and blue LED devices. In other embodiments, the synchronizer may be configured to synchronously activate and deactivate at least a first one of the arrays of LED devices and at least a first one of the arrays of color picture elements, and to alternatingly synchronously activate and deactivate at least a second one of the arrays of LED devices and at least a second one of the arrays of color picture elements. Thus, for example, in embodiment 241, the green picture elements and the green LEDs are synchronously activated and deactivated. In a second embodiment 242, the blue LEDs are pulsed multiple times synchronously with activation and deactivation of the blue pixels. In a third embodiment 243, the green picture elements and the green LEDs are synchronously activated and deactivated alternatingly with synchronous activation and deactivation of the blue picture elements and blue LEDs. In embodiment 244, the red and blue picture elements and the red and blue LEDs are synchronously activated and deactivated and, alternatingly, the green picture elements and green LEDs are synchronously activated and deactivated. Finally, in embodiment 245, the green LEDs are pulsed multiple times in synchronism with activation and deactivation of the green pixels and, alternatingly, the blue LEDs are pulsed multiple times in synchronism with activation and deactivation of the blue picture elements. It also will be understood that many other combinations and subcombinations of synchronization and alternating synchronization, with or without pulsing, may be provided according to various embodiments of the present invention.

Figure 3A:
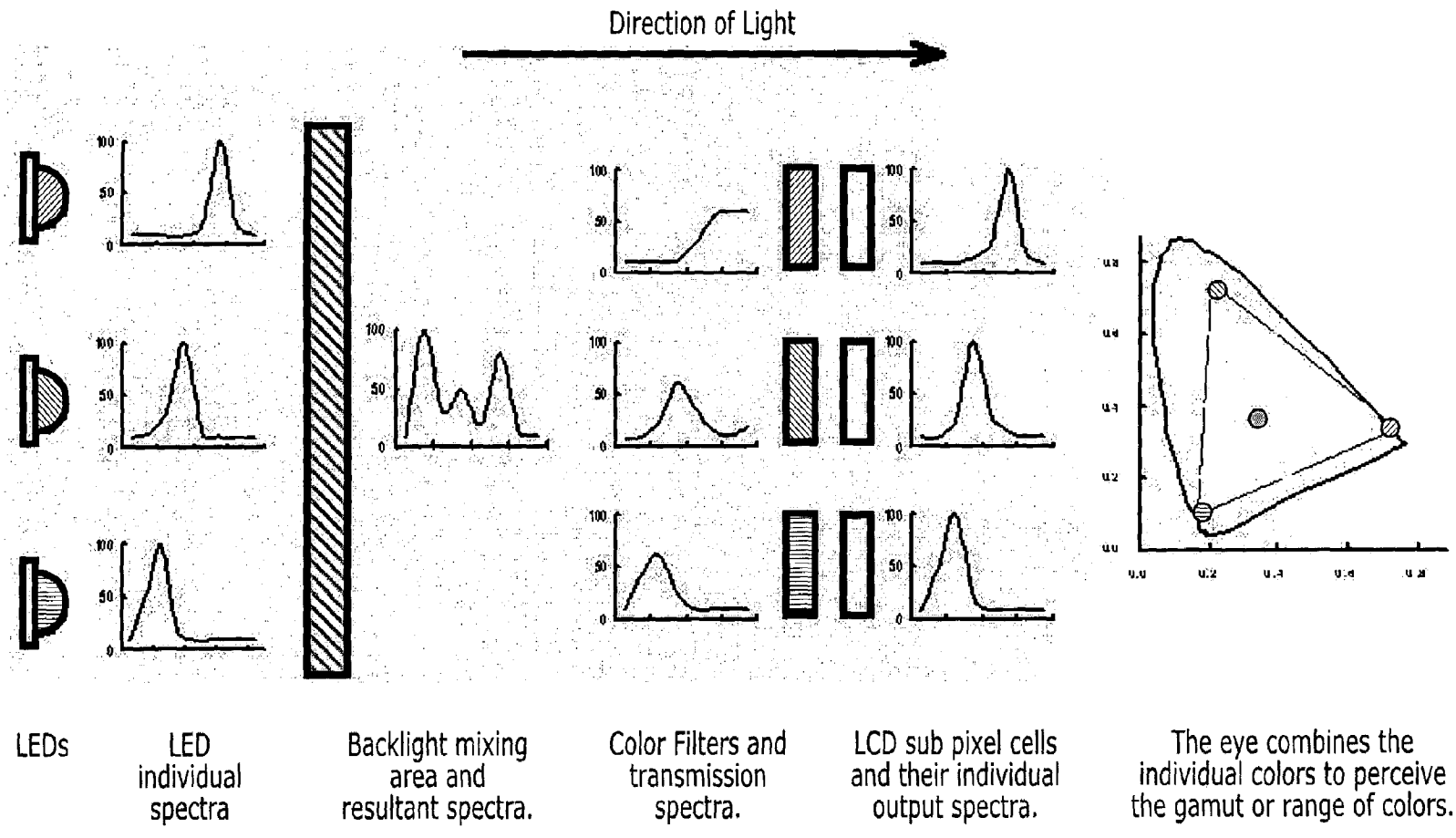
FIG. 3A (PRIOR ART)
FIGS. 3A and 3B schematically illustrate operation of conventional non-switched display panels and alternating synchronized activated display panels according to various embodiments of the present invention, respectively.
Figure 3B:
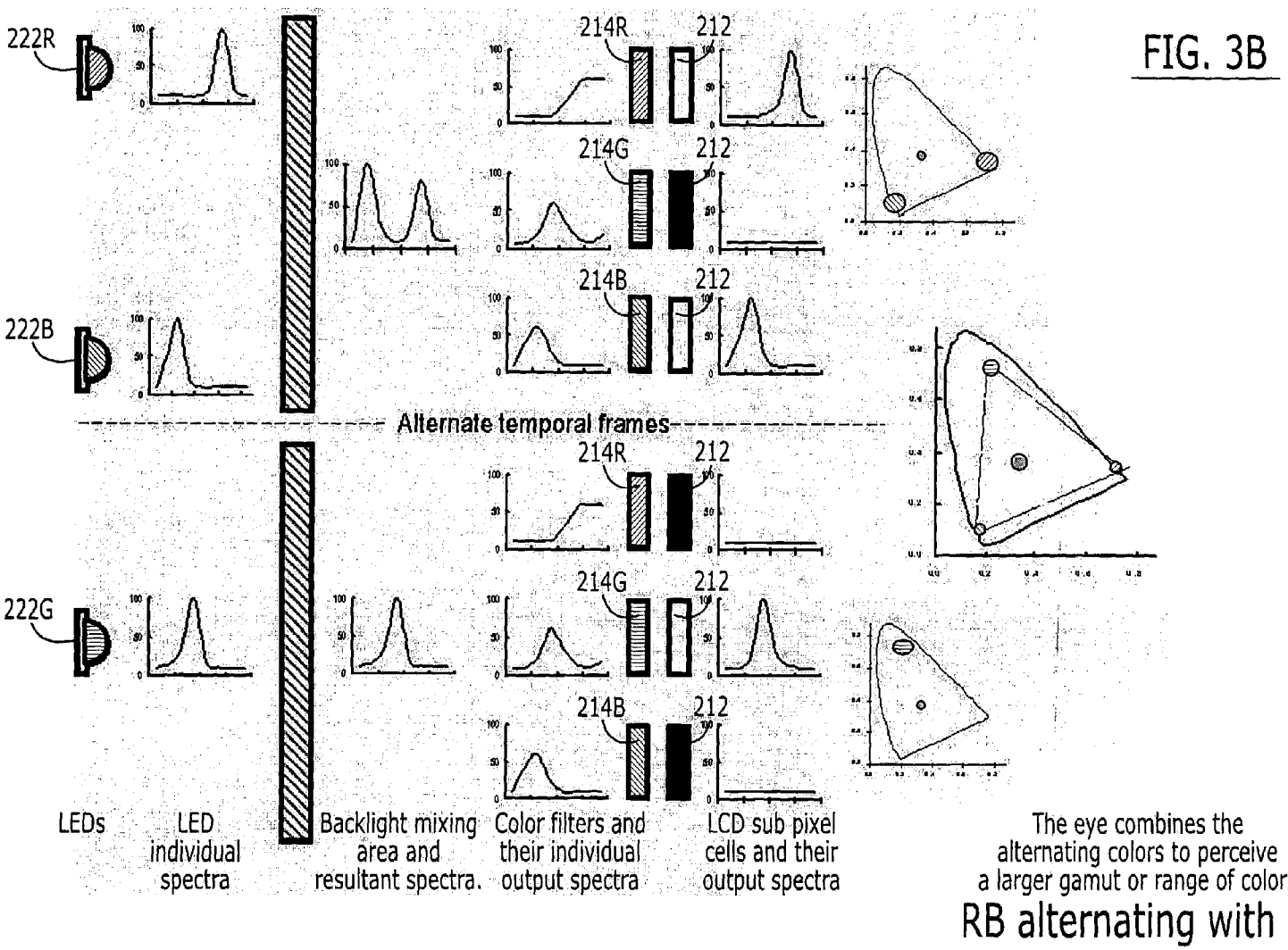

FIG. 3 schematically illustrates operation of a conventional non-switched RGB LCD panel. Viewing FIG. 3 from left to right, the red, green and blue LEDs and their individual LED spectra are shown. In a mixing area, the backlight is mixed to provide the resultant spectra as shown. The light then passes through the color filters, which provide the color transmission spectra as shown. The LCD pixel or subpixel cells, therefore, provide the individual output spectra shown. The eye combines the individual colors to perceive the gamut or range of colors, as shown in FIG. 3.

Figure 4:
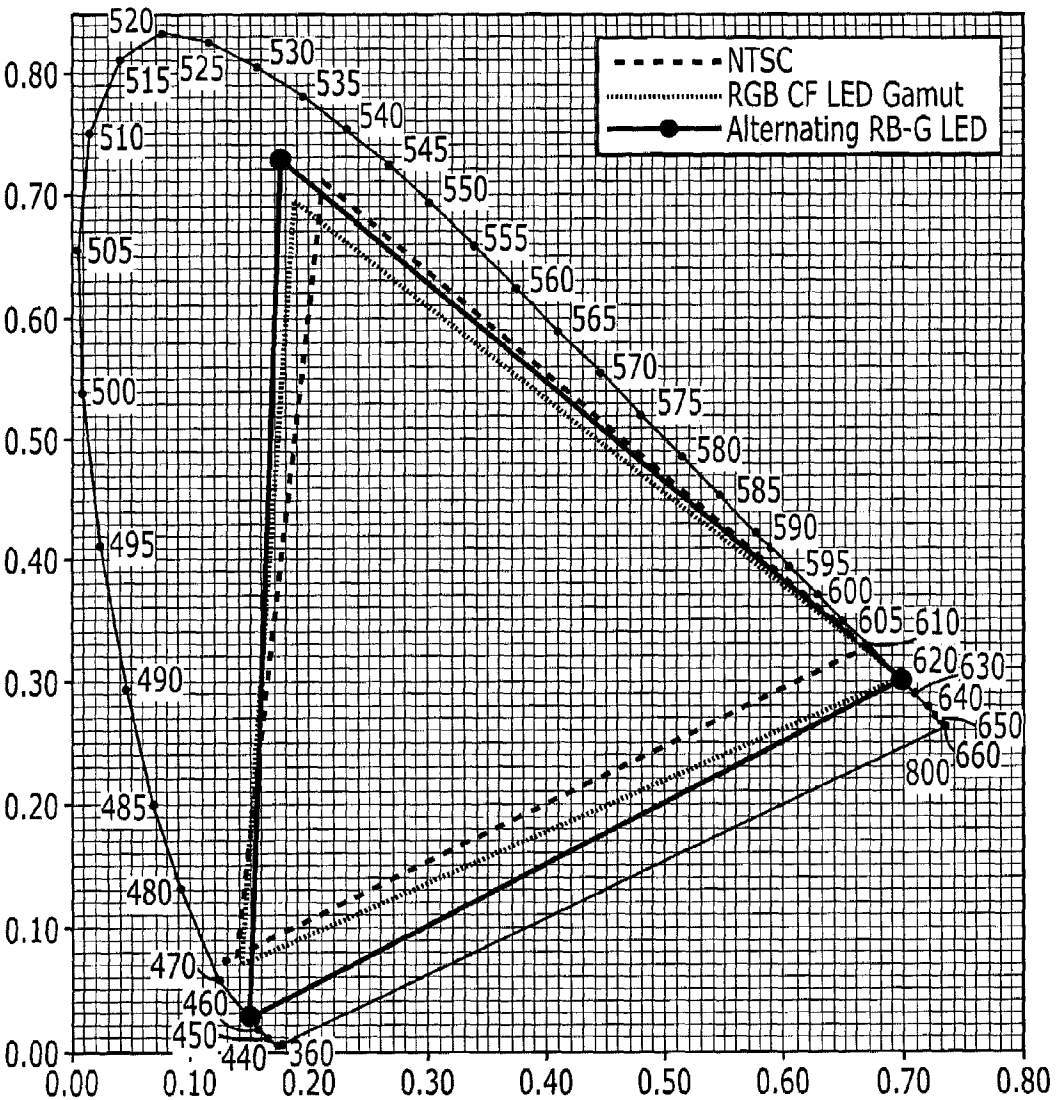
FIG. 4 graphically illustrates color gamuts for conventional displays and displays with alternating synchronized backlighting according to various embodiments of the present invention.

FIG. 4 schematically illustrates movement of light through an LCD panel with LED backlighting and a synchronizer according to embodiments of the present invention, and more specifically illustrates embodiment 244 of FIG. 2, wherein the red and blue color filters and LEDs are alternatingly synchronized with the green color filters and LEDs. Thus, referring to FIG. 4 from left to right, and referring to the first time (temporal) frame shown at the top half of FIG. 4, the red and blue LEDs 222R and 222B are activated along with the red and blue LCD color filters 214R, 214B. The white box adjacent the red and blue LED color filters 214R, 214B indicate that the LCDs 212 are activated, whereas the black box adjacent the green color filter 214G indicates that the LCD 212 is turned off. The resultant color output and color gamut is shown at the top half of FIG. 4 on the right side. Thus, the top half of FIG. 4 illustrates how a synchronizer can synchronously activate and deactivate the array of red picture elements and blue picture elements, and the array of red and blue LEDs.

Still referring to FIG. 4 in an alternate time frame, shown at the bottom half of FIG. 4, the green LED 222G is activated and deactivated along with the green color filter 214G. The red and blue color filters are off, as shown by the black LCDs 212 adjacent the red and blue color filters. Thus, the bottom half of FIG. 4 illustrates synchronously activating and deactivating the array of green LED devices and the array of green color picture elements. Moreover, the top and bottom portions of FIG. 4 illustrate synchronously activating and deactivating the array of red and blue LED devices and the array of red and blue color picture elements and alternatingly synchronously activating and deactivating the array of green LED devices and the array of green color picture elements, corresponding to embodiment 244 of FIG. 2. As shown at the extreme right of FIG. 4, the eye combines the alternating colors to perceive a larger gamut or range of colors than was shown in FIG. 3.

FIG. 4 illustrates a standard NTSC color gamut (dashed line) for a display. FIG. 4 also illustrates (dotted line) a color gamut of a conventional display panel that includes red, green and royal blue backlight LEDs (mixed in respective intensities of 105%, 180% and 123%, to provide a gamut that has an area of 120% of the NTSC gamut). FIG. 4 also illustrates a simulated color gamut (solid line) that may be provided by multiplexing the red and blue backlighting LEDs 222R, 222B and the green backlighting LEDs 222G according to embodiments of the present invention, as was shown in FIG. 3B and embodiment 244 of FIG. 2. An expanded color gamut is shown for alternating synchronized backlighting (solid line) according to embodiments of the invention, compared to the NTSC color gamut (dashed line) and the conventional display panel gamut (dotted line).

Some embodiments of the present invention may arise from a recognition that, by alternating the blue backlighting LED array 222B with the green backlighting LED array 222G, the color filters 214 need not transmit green light at the same time as blue light, so that the potential overlap among the color filters at any given time (illustrated in FIG. 3) may be reduced, minimized and/or substantially eliminated. Bleed through may be reduced, and the individual color output spectra can be sharpened. Yet, by alternating the blue array 222B and the green array 222G at a fast enough rate, backlighting that is perceived as white light may be provided. Accordingly, for a given configuration of LCD devices 212, color filters 214 and backlighting LEDs 222, the color gamut may be unexpectedly increased, in some embodiments of the invention, by alternating the synchronized blue backlighting LEDs and blue color filters with the green backlighting LEDs and green color filters. In some embodiments of the present invention, as described above, the red LEDs/color filters may be activated/deactivated along with the blue LEDs/color filters. In still other embodiments, the red LEDs/color filters need not be alternated, but may be maintained on with the blue and green LEDs/color filters, as shown by embodiments 245. These embodiments may arise from a recognition that the red color filters of FIG. 3 may overlap less with the green color filters than the blue color filters overlap with the green color filters, so that the red color filters need not be alternated in order to realize the potential advantage of alternatingly activating and deactivating the blue and green LEDs. Moreover, in other embodiments, the color gamut may be reduced or may not be increased as much, but the intensity of the display may be increased.

Figure 5:
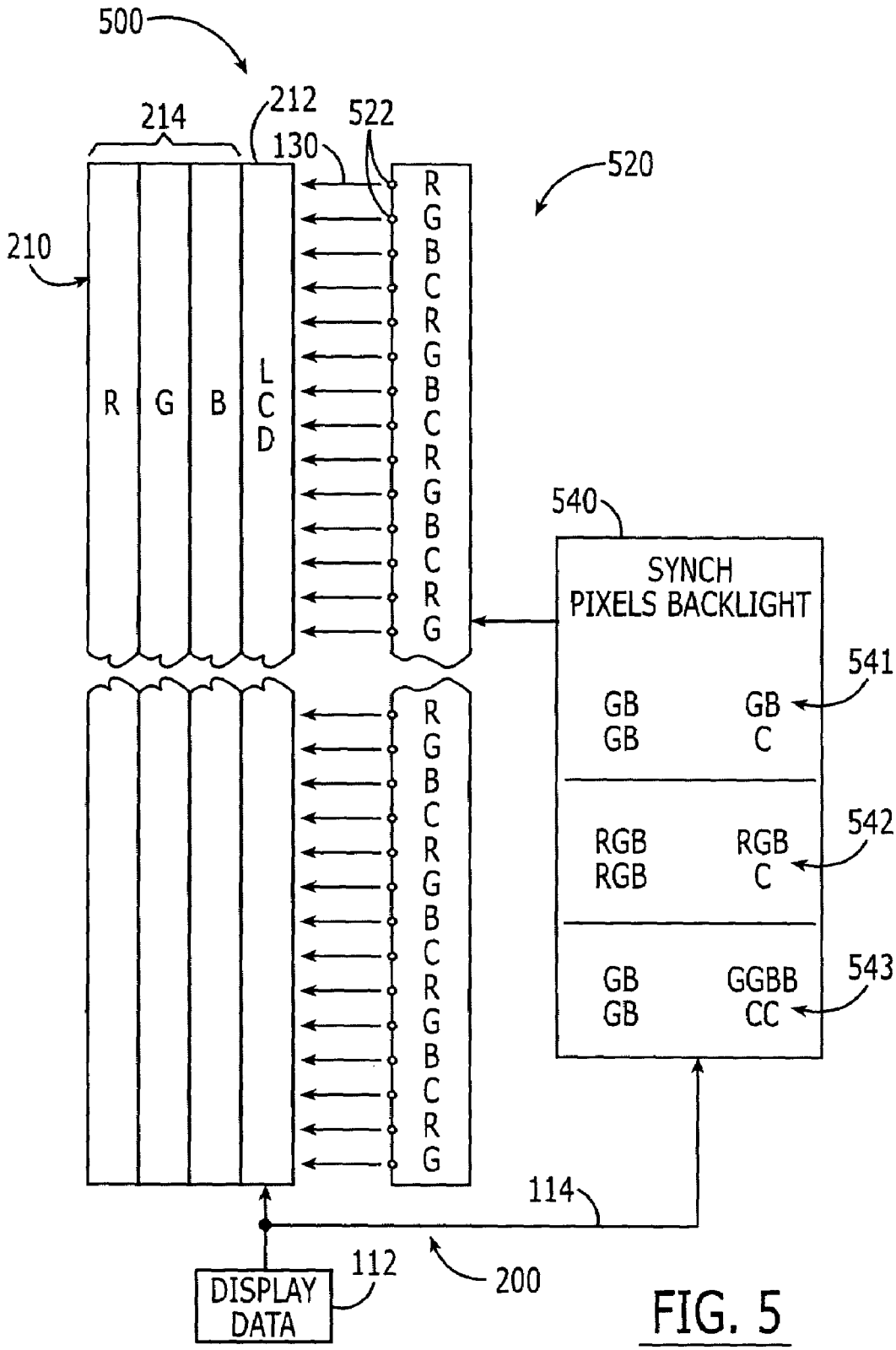
FIGS. 5 and 6 are cross-sectional views of display panels according to various other embodiments of the present invention.

FIG. 5 is a cross-sectional view of display panels including backlight systems and methods according to yet other embodiments of the present invention. As shown in FIG. 5, the display panel 210 may be configured as was already described in connection with FIG. 2. The backlight system and method 520, however, includes an array of red, green, blue and cyanine LED devices 522R, 522G, 522B and 522C, respectively. In some embodiments, the cyanine LEDs have a center frequency of about 495 nm to about 505 nm. As shown in FIG. 5, a synchronizer 540 is configured to synchronously activate and deactivate the array of green and blue LED devices 522G, 522B and the array of green and blue color picture elements 214G and 214B, and to alternatingly synchronously activate and deactivate the array of cyanine LED devices 522C and arrays of red, green and blue color picture elements 214R, 214G, 214B, as shown in a first embodiment 541. In a second embodiment 542, the red LEDs 522R may be activated and deactivated along with the green and blue LEDs 522G, 522B, but not with the cyanine LEDs 522C. In still other embodiments 543, pulsing of the green, blue and/or cyanine LEDs also may be provided. It will be understood by those having skill in the art that various combinations and subcombinations of embodiments 541-543 and/or other embodiments may be provided. For example, three alternating cycles of synchronous activation and deactivation may be provided.

Figure 6:
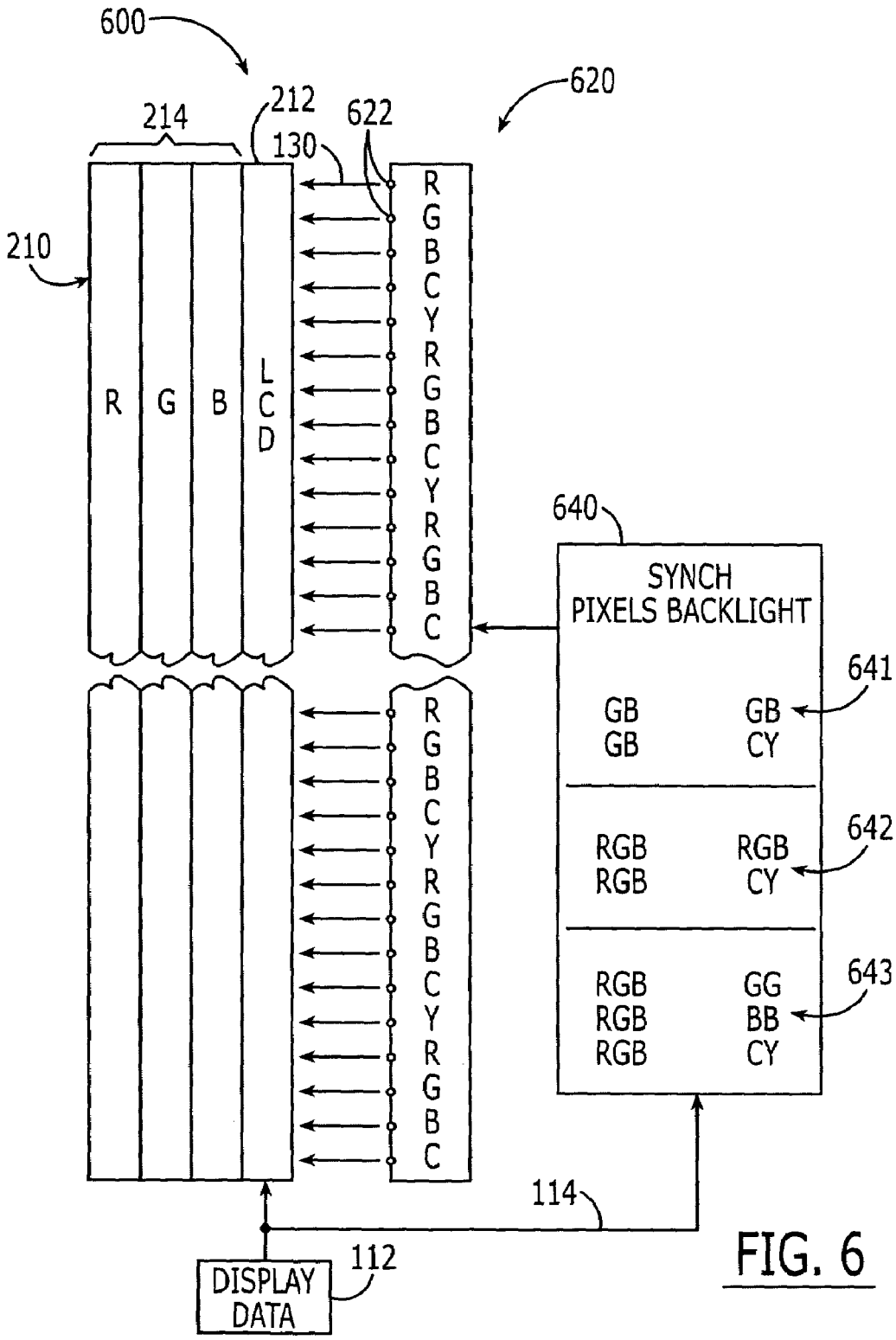

FIG. 6 is a cross-sectional view of still other embodiments of the present invention. In embodiments of FIG. 6, the display panel 600 includes backlighting systems and methods 620 having arrays of red, green, blue, cyan and yellow (also referred to as amber) LEDs, 622R, 622G, 622B, 622C and 622Y. In some embodiments, the yellow LEDs have a center frequency of about 570 nm. The synchronizer 640 may be configured to synchronize the red, green, blue, cyanine and/or yellow LEDs with the red, green and/or blue pixels, and alternate the activation and deactivation of the synchronized red, green, blue, cyanine and/or yellow LEDs and the red, green and/or blue pixels. For example, in a first mode 641, the green and blue pixels 214G, 214B and the green and blue LEDs 622G, 622B are synchronously activated and deactivated and, alternatingly, the green and blue pixels 214G, 214B and the cyanine and yellow LEDs 622C, 622Y are activated. The red LEDs 622R and pixels 214R may be synchronously activated and deactivated in both of the alternating cycles. In embodiment 642, the red LEDs 622R are only activated and deactivated in synchronism with the green and blue LEDs 622G, 622B, and are not activated during the alternating activation of the cyanine and yellow LEDs 622C, 622Y. Finally, in embodiment 643, three alternating cycles are provided wherein the green LEDs are pulsed, the blue LEDs are activated, and the cyanine and yellow LEDs are activated. The red LEDs may be activated with any or all of the cycles. It will also be understood that combinations and subcombinations of modes 641-643 and/or other modes may be provided according to other embodiments of the present invention.

Figure 7:
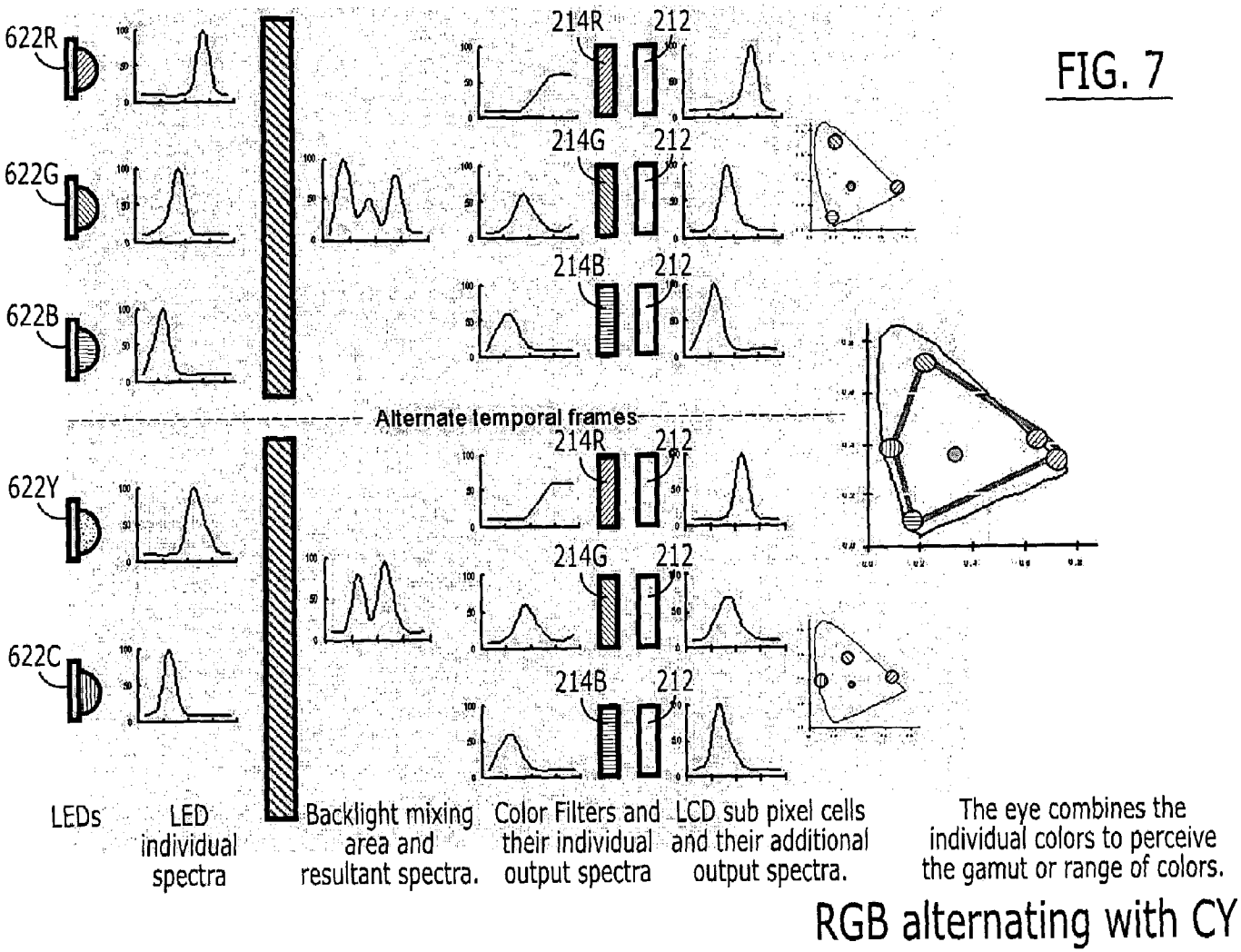
FIG. 7 schematically illustrates operations with alternating RGB and CY backlighting LEDs according to various embodiments of the present invention.

FIG. 7 schematically illustrates how the color gamut may be increased by alternating the activation and deactivation of the synchronized red, green and blue LEDs and LCD picture elements, and the synchronized cyan and yellow LEDs and the red, green and blue picture elements. As shown in FIG. 7, in the alternate temporal frames where the yellow and cyan LEDs are activated, all three LCD picture elements (red, green and blue) also may be activated. However, in other embodiments, all three LCD picture elements need not be activated.

Figure 8:
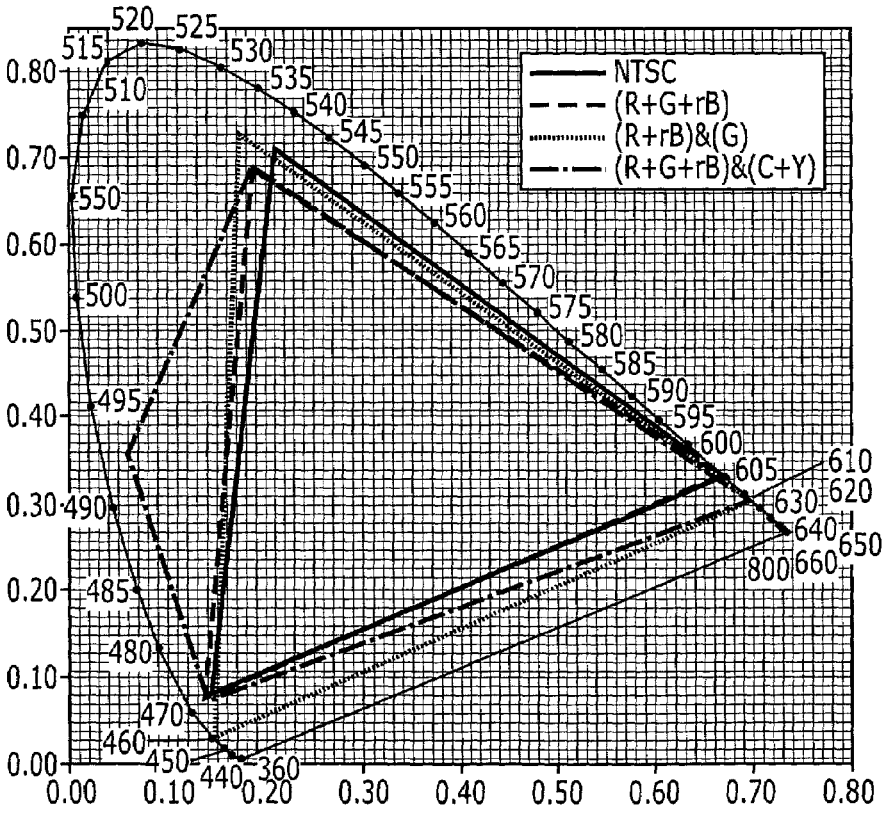
FIG. 8 graphically illustrates an NTSC standard color gamut and color gamuts using alternating synchronized backlighting LEDs according to other embodiments of the present invention.

FIG. 8 simulates how the color gamut (solid line) may be increased compared to the NTSC color gamut (dashed line) by alternating the RB (actually royal blue (rB)) and green LEDs, and by alternating the RGB and CY LEDs, as shown in embodiments 244 and 642, where mixing is performed according to the intensities shown in FIG. 8. Increased color gamut by alternating activation of arrays of LEDs is therefore simulated in FIG. 8.

FIGS. 1-2, 3B and 4-8 also illustrate methods of increasing a color gamut of a display panel according to embodiments of the present invention, wherein the display panel includes an array of LCD devices including at least two color filters thereon, and at least two arrays of LED devices that are configured to radiate light of the respective at least two colors in a light path that impinges on the display screen, to provide backlighting on the display screen. These methods comprise synchronously activating and deactivating at least a first one of the arrays of LED devices and at least a first one of the arrays of color picture elements. Various method analogs of FIGS. 1-2, 3B and 4-8 may be provided. Moreover, in any of the embodiments of FIGS. 1-2, 3B and 4-8, backlight sources other than LEDs (such as field emitters) may be used and/or shutterable displays other than LCDs (such as holographic optical elements) may be used.

Additional discussion of various embodiments of the present invention now will be provided. Presently, shutterable displays (LCD or other types) may not actually depict the true color of images. The gamut generally is restricted due to the color chromaticity values of the red, green and blue sources, such as phosphors in the screen or LCD color filters with a white light backlit source. Hence, if one displays, for example, a photograph on a display screen and then prints the photograph on paper, the print may not match the image on the display screen.

Some embodiments of the present invention can allow improved color gamut by alternating between blue and green; between green and blue and cyanine; between blue/green and cyanine; between green/blue and cyanine/yellow; and/or between blue and green and cyanine/yellow backlighting, due to the overlap and bleed-through of a standard filter system. By allowing improved color gamut, the image may be better rendered on the display. Red can be on all the time or can be alternated.

In some embodiments, the blue color filter is used for the blue backlight source or the cyanine backlight source, so that these backlight sources are alternated (blue on, cyanine off, and cyanine on, blue off). Additionally, since the green filter is used for the green backlight source and the amber or yellow backlight source, these also can be alternated (green on, amber off, and amber on, green off). The red backlight LED may be on all the time or can be alternated with either backlight source(s).

Using a series of pulses to reduce visual flicker, according to various embodiments of the present invention, now will be described. In particular, images generally are presented on television and computer monitors as a series of image frames. The frequency that the image is refreshed generally is selected to be greater than the human visual system's "critical flicker frequency". For television, this frequency is generally either 50 or 60 Hz. For computer monitors, higher frequencies, such as 75 Hz are sometimes selected to reduce eye strain. For film-type motion pictures, images are presented at 24 frames per second. To remove the flicker of 24 Hz, each image is presented twice by interrupting the light source at a frequency of 48 Hz. This interruption "fools" the human visual system and the images perceived with flicker, because it is presented at an apparent 48 Hz.

LCD shutters may take up to 16 ms to change state. While a 16 ms refresh time may be sufficient to present the individual frames without flicker, the change is not instantaneous and moving images may tend to blur. This blur can be reduced by using more sophisticated and potentially expensive LCD materials and/or technologies. Such materials may have switching times as fast as 8 ms. However, some perceivable blur still may be present. Another way to potentially reduce this blur is to pre-bias the LCD ahead of the change, so that it is "ready" to change. However, pre-biasing may use special driving circuits. Re-biasing may be used today in advanced LCD televisions.

Figure 9:
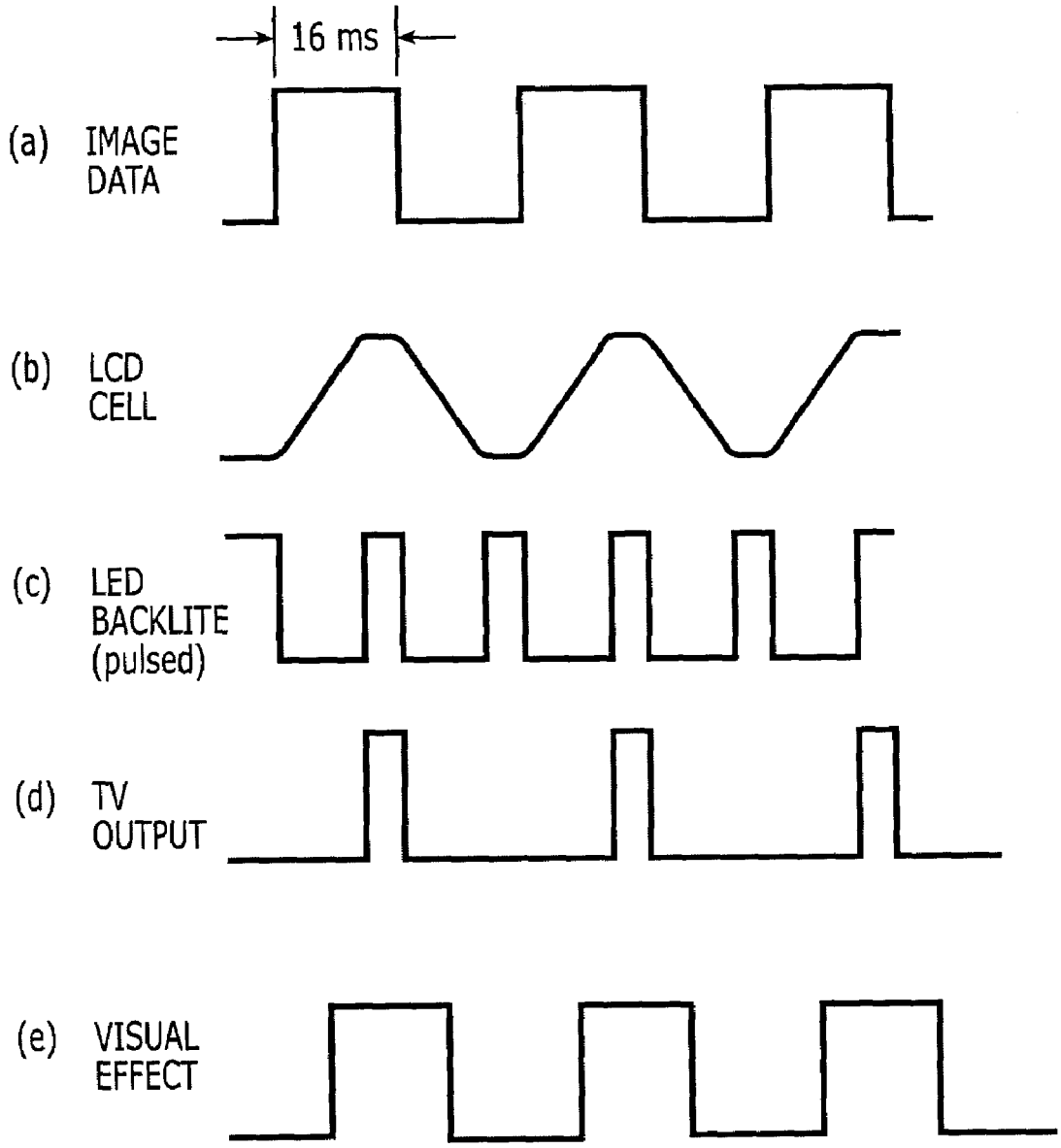
FIGS. 9 and 10 are timing diagrams illustrating pulsing of backlighting LEDs according to various embodiments of the present invention.

According to some embodiments of the present invention, another way to reduce this blur is to pulse the backlight such that it is only illuminated for a small portion of the refresh cycle. This pulsing may be performed because the LED can have near instantaneous switch times. FIG. 9 graphically illustrates the image data (a), the LCD pixels (b) with the relatively slow switching time, a pulsed LED backlight (c), the resultant output (d) and the visual effect (e). Moving images, therefore, may seem less blurred. The brightness intensity lost due to reducing the time the backlight is illuminated can be compensated by increasing the drive current of the LEDs when they are illuminated, so that the average illumination can be made the same. Accordingly, some embodiments of the present invention can reduce image degradation such as blur and/or flicker of a display panel that includes a display screen comprising an array of at least two different color picture elements and an array of LED devices that are configured to radiate light in a light path that impinges on the display screen to provide backlighting on a display screen, by pulsing the array of LED devices to radiate pulses of light in the light path that impinges on the display screen to provide pulse backlighting on the display screen.

According to other embodiments of the invention, pulse backlighting may be combined with alternating backlighting, as was described in connection with, for example, embodiments 144, 145, 146, 242, 245, 543 and 643. More specifically, when alternating LCD frames in the color domain according to embodiments of the present invention, it may be desirable to provide a full LCD switching time in each color frame. While a switching frequency of about 200 Hz may be desirable, conventional LCDs may only be able to switch at 60 Hz. With a 60 Hz refresh rate and a color alternation of 2, as shown, for example, in FIGS. 3B and 7, the presented image may flicker at 30 Hz.

Using an LCD with a higher switch frequency may reduce this flicker. For example, an LCD with a switching time of 10 ms can display a two-frame color multiplexed image at 50 Hz. However, even 50 Hz may provide a barely acceptable refresh rate.

In contrast, according to embodiments of the present invention, during selected or each color frame of the alternating sequence, the backlight is pulsed with a series of two or more pulses. The flicker can be reduced such that even standard 16 ms LCDs can be used.

Figure 10:
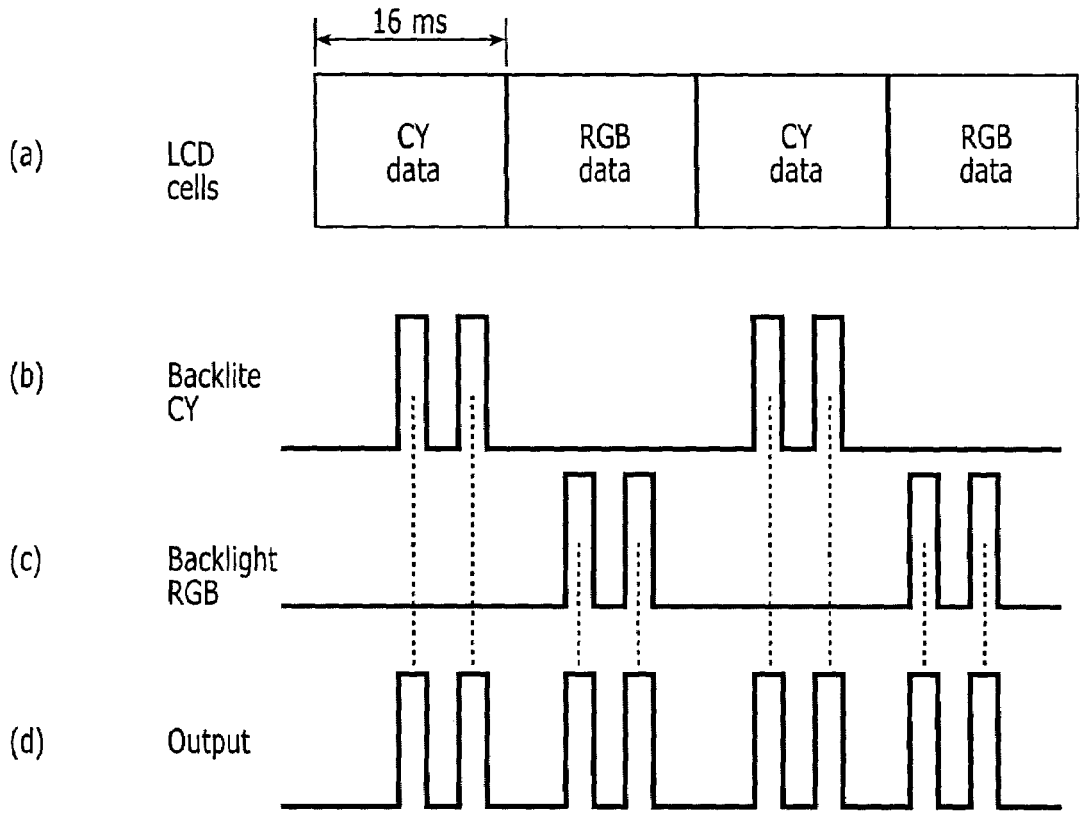

FIG. 10 graphically illustrates pulsing of alternating groups of LCDs according to embodiments of the present invention. Embodiments 642 are illustrated. The alternating CY and RGB LCD cells are shown at (a) and the pulsing backlight is shown at (b) for the CY LEDs and at (c) for the RGB LEDs. The total output is shown at (d). Pulsing according to embodiments of the present invention can, therefore, allow reduced flicker and eye strain, allow reduced blur from moving images and/or allow the use of cheaper 16 ms LCDs in color multiplex applications for a wide gamut.

It also will be understood by those having skill in the art that various combinations and subcombinations of embodiments of FIGS. 1-2, 3B and 4-10 may be provided according to various other embodiments of the present invention.

In the drawings and specification, there have been disclosed embodiments of the invention and, although specific terms are employed, they are used in a generic and descriptive sense only and not for purposes of limitation, the scope of the invention being set forth in the following claims.

What is claimed is:

1. A backlight system for a display screen that includes an array of Liquid Crystal Display (LCD) devices including arrays of red, green and blue color filters thereon to provide red, blue and green color picture elements, the backlight system comprising:

arrays of red, green, blue and cyanine Light Emitting Diode (LED) devices that are configured to radiate light of red, green, blue and cyanine colors in a light path that impinges on the display screen to provide backlighting on the display screen; and a synchronizer that is configured to synchronously activate and deactivate the arrays of green and blue LED devices and the arrays of green and blue color picture elements and to alternatingly synchronously activate and deactivate the array of cyanine LED devices and the arrays of red, green and blue color picture elements.

2. A backlight system according to claim 1 wherein the synchronizer is configured to activate and deactivate at least a first one of the arrays of LED devices multiple times in synchronism with a single activation and deactivation of at least a first one of the arrays of color picture elements.

3. A backlight system according to claim 1 wherein the synchronizer is configured to pulse at least a first one of the arrays of LED devices multiple times in synchronism with a single activation and deactivation of at least a first one of the arrays of color picture elements.

4. A backlight system according to claim 1 further comprising an array of amber LED devices that is configured to radiate light of amber color in the light path that impinges on the display screen to provide backlighting on the display screen and wherein the synchronizer is further configured to synchronously activate and deactivate the arrays of green and blue LED devices and the arrays of green and blue color picture elements and to alternatingly synchronously activate and deactivate the arrays of cyanine and amber LED devices and the arrays of red, green and blue color picture elements.

5. A backlight system according to claim 1 wherein the synchronizer is further configured to synchronously activate and deactivate the array of green LED devices and the array of green color picture elements, to alternatingly synchronously activate and deactivate the array of blue LED devices and the array of blue color picture elements and to alternatingly synchronously activate and deactivate the array of cyanine LED devices and the arrays of red, green and blue color picture elements.

6. A backlight system according to claim 1 further comprising an array of amber LED devices that is configured to radiate light of amber color in the light path that impinges on the display screen to provide backlighting on the display screen and wherein the synchronizer is configured to synchronously activate and deactivate the array of green LED devices and the array of green color picture elements, to alternatingly synchronously activate and deactivate the array of blue LED devices and the array of blue color picture elements and to alternatingly synchronously activate and deactivate the array of cyanine and amber LED devices and the arrays of red, green and blue color picture elements.

7. A display screen comprising the array of LCD devices including arrays of red, green and blue color filters thereon and a backlight system according to claim 1.

8. A method of increasing a color gamut of a display panel that includes a display screen comprising an array of Liquid Crystal Display (LCD) devices including arrays of red, green and blue color filters thereon to provide red, blue and green color picture elements and arrays of red, green, blue and cyanine Light Emitting Diode (LED) devices that are configured to radiate light of red, green, blue and cyanine colors in a light path that impinges on the display screen to provide backlighting on the display screen, the method comprising:

synchronously activating and deactivating the arrays of green and blue LED devices and the arrays of green and blue color picture elements and alternatingly synchronously activating and deactivating the array of cyanine LED devices and the arrays of red, green and blue color picture elements.

9. A method according to claim 8 further comprising activating and deactivating at least a first one of the arrays of LED devices multiple times in synchronism with a single activation and deactivation of at least a first one of the arrays of color picture elements.

10. A method according to claim 8 further comprising pulsing at least a first one of the arrays of LED devices multiple times in synchronism with a single activation and deactivation of at least a first one of the arrays of color picture elements.

11. A method according to claim 8 wherein the display screen further comprises an array of amber LED devices that is configured to radiate light of amber color in the light path that impinges on the display screen to provide backlighting on the display screen and wherein synchronizing further comprises synchronously activating and deactivating the arrays of green and blue LED devices and the arrays of green and blue color picture elements and alternatingly synchronously activating and deactivating the arrays of cyanine and amber LED devices and the arrays of red, green and blue color picture elements.

12. A method according to claim 8 wherein synchronizing further comprises synchronously activating and deactivating the array of green LED devices and the array of green color picture elements, alternatingly synchronously activating and deactivating the array of blue LED devices and the array of blue color picture elements and alternatingly synchronously activating and deactivating the array of cyanine LED devices and the arrays of red, green and blue color picture elements.

* * * * *